US011879649B2

(12) United States Patent
Sakai et al.

(10) Patent No.: US 11,879,649 B2
(45) Date of Patent: Jan. 23, 2024

(54) OUTDOOR UNIT OF AIR-CONDITIONING APPARATUS WITH CORNER GRASP PORTIONS

(71) Applicant: Mitsubishi Electric Corporation, Tokyo (JP)

(72) Inventors: Mizuo Sakai, Tokyo (JP); Noka Sakabe, Tokyo (JP); Tetsuya Yamashita, Tokyo (JP); Masafumi Tomita, Tokyo (JP); Hirokazu Murakami, Tokyo (JP); Yuya Hata, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 612 days.

(21) Appl. No.: 17/058,811

(22) PCT Filed: Jul. 19, 2018

(86) PCT No.: PCT/JP2018/027082

§ 371 (c)(1),
(2) Date: Nov. 25, 2020

(87) PCT Pub. No.: WO2020/016989

PCT Pub. Date: Jan. 23, 2020

(65) Prior Publication Data

US 2021/0207822 A1 Jul. 8, 2021

(51) Int. Cl.
*F24F 1/56* (2011.01)
*F24F 13/20* (2006.01)

(52) U.S. Cl.
CPC ..... *F24F 1/56* (2013.01); *F24F 13/20* (2013.01)

(58) Field of Classification Search
CPC ..... F24F 1/56; F24F 13/20
See application file for complete search history.

(56) References Cited

U.S. PATENT DOCUMENTS

D150,912 S * 9/1948 Underwood ..... A47B 95/02 D8/DIG. 1
2,771,627 A * 11/1956 Hammer ..... A47B 95/02 16/416

(Continued)

FOREIGN PATENT DOCUMENTS

CN 1952501 A 4/2007
CN 203298409 U 11/2013

(Continued)

OTHER PUBLICATIONS

Office Action dated Aug. 4, 2021 issued in corresponding CN patent application No. 201880094049.4 (and English translation).

(Continued)

*Primary Examiner* — Travis Ruby
(74) *Attorney, Agent, or Firm* — POSZ LAW GROUP, PLC

(57) ABSTRACT

An outdoor unit of an air-conditioning apparatus includes a casing, and grasp portions provided at corner portions of the casing in plan view. Each grasp portion includes an outer peripheral portion at an outer periphery, and a finger hook portion protruding downward from an upper part of the outer peripheral portion and extending in a lateral direction of the finger hook portion. The outer peripheral portion includes a first opening such that a lower end portion of the finger hook portion is exposed as seen in a horizontal direction and a direction perpendicular to the lateral direction, a second opening below the finger hook portion and continuous with the first opening, and a third opening behind the finger hook portion and continuous with the second opening, the second opening and the third opening are at one of the lateral end portions.

4 Claims, 5 Drawing Sheets

(56) References Cited

U.S. PATENT DOCUMENTS

| | | | | | |
|---|---|---|---|---|---|
| 2,793,386 | A * | 5/1957 | Muhlhauser | A47B 95/02 | 16/416 |
| 3,098,686 | A * | 7/1963 | Benoit | A47B 95/02 | 16/416 |
| 3,969,009 | A * | 7/1976 | Radek | A47B 95/02 | 16/416 |
| 4,090,756 | A * | 5/1978 | Frey | A47B 95/02 | 16/443 |
| 4,093,327 | A * | 6/1978 | Linger | A47B 95/02 | 16/443 |
| D257,714 | S * | 12/1980 | Heuser | D8/331 | |
| 4,744,126 | A * | 5/1988 | Bisbing | A45C 13/26 | 16/443 |
| 5,134,754 | A * | 8/1992 | Vickers | A47B 95/02 | 16/416 |
| D349,838 | S * | 8/1994 | Barton | A47B 95/02 | D8/301 |
| 5,927,836 | A * | 7/1999 | Herr | D06F 39/12 | 312/263 |
| 6,000,075 | A * | 12/1999 | Urness | A47C 23/14 | 16/443 |
| 2012/0274188 | A1* | 11/2012 | Shiborino | F24F 1/56 | 312/100 |
| 2014/0132127 | A1 | 5/2014 | Kawaguchi et al. | | |

FOREIGN PATENT DOCUMENTS

| | | | |
|---|---|---|---|
| JP | H08-094127 | A | 4/1996 |
| JP | 2010-175134 | A | 8/2010 |
| JP | 2014-095533 | A | 5/2014 |

OTHER PUBLICATIONS

International Search Report of the International Searching Authority dated Sep. 18, 2018 for the corresponding international application No. PCT/JP2018/027082 (and English translation).

Office Action dated Dec. 24, 2021 issued in corresponding CN patent application No. 201880094049.4 (and English translation).

* cited by examiner

OUTDOOR UNIT OF AIR-CONDITIONING APPARATUS WITH CORNER GRASP PORTIONS

CROSS REFERENCE TO RELATED APPLICATION

This application is a U.S. national stage application of International Application No. PCT/JP2018/027082 filed on Jul. 19, 2018, the contents of which are incorporated herein by, reference.

TECHNICAL FIELD

The present invention relates to an outdoor unit of an air-conditioning apparatus, which is provided with grasp portions to be grasped by a worker.

BACKGROUND ART

When carrying an outdoor unit of an air-conditioning apparatus, and for example, installing the outdoor unit, a worker sometimes vertically moves the outdoor unit or horizontally moves the outdoor unit. Therefore, a casing of the outdoor unit is formed to include grasp portions (see, for example, Patent Literature 1). The worker moves the outdoor unit while grasping the grasp portions of the outdoor unit. To be more specific, the worker inserts his or her fingers other than his or her thumbs into the grasp portions, and moves the outdoor unit while supporting the weight of the outdoor unit with the fingers other than the thumbs. It should be noted that each grasp portion may also be referred to as a handle.

CITATION LIST

Patent Literature

Patent Literature 1: Japanese Unexamined Patent Application Publication No. 8-94127

SUMMARY OF INVENTION

Technical Problem

The size of a hand varies from one worker to another. Furthermore, from the standpoint of safety in the case where an outdoor unit is moved, the worker wears protectors such as gloves on his or her hands, and grasps the grasp portions. Therefore, preferably, the grasp portions should be large.

However, in the casing of the outdoor unit, components such as electrical components, a compressor, pipes and a heat exchanger are housed. In recent years, because of demands for higher performance and miniaturization of air-conditioning apparatuses, the occupancy rate of components in the casing has been higher. Thus, in the housings of outdoor units of recent times, a region for grasp portions at the casing has been smaller. It is therefore hard to provide large grasp portions at the casing of an outdoor unit.

Therefore, an existing outdoor unit has the following problem. When the worker inserts his or her fingers other than his or her thumbs into grasp portions to move the existing outdoor unit, only the tips of the fingers can be inserted in the grasp portions because the grasp portions have small widths. Inevitably, the worker has to support the weight of the outdoor unit with the tips of the fingers. Therefore, when the worker moves the existing outdoor unit, he or she feels that the outdoor unit is heavy, and the workability with which the worker moves it is bad.

The present invention has been made to solve the above problem, and an object of the invention is to obtain an outdoor unit of an air-conditioning apparatus, that ensures that the workability with which the outdoor unit of the air-conditioning apparatus is moved is improved, as compared with the case where the existing outdoor unit is moved.

Solution to Problem

An outdoor unit of an air-conditioning apparatus according to an embodiment of the present invention includes a casing, and grasp portions provided at at least two respective positions at corner portions of the casing as seen in plan view. The grasp portions each include an outer peripheral portion forming an outer periphery of each grasp portion, and a finger hook portion protruding downwards from an upper part of the outer peripheral portion and extending in a lateral direction of the finger hook portion. The outer peripheral portion includes: a first opening provided such that a lower end portion of the finger hook portion is exposed as seen in a horizontal direction and a direction perpendicular to the lateral direction; a second opening provided below the finger hook portion and continuous with the first opening; and a third opening provided behind the finger hook portion and continuous with the second opening, the second opening and the third opening being provided at one of end portions of the outer peripheral portion which are located at ends thereof in the lateral direction.

Advantageous Effects of Invention

In the outdoor unit of an air-conditioning apparatus according to the embodiment of the present invention, in the case where the region for providing each of the grasp portions is small, and each grasp portion has a small width, at least part of an index finger or a little finger on one hand may be placed outside the grasp portion through the second opening and the third opening formed at an end portion of the grasp portion which is located at an end thereof in the lateral direction. Therefore, in the outdoor unit of the air-conditioning apparatus according to the embodiment of the present invention, a worker can insert his or her fingers, which are to be inserted into the grasp portions, into the grasp portions until portions of the fingers which are closer to bases of the fingers than tips thereof are located in the grasp portions. Thus, when moving the outdoor unit of the air-conditioning apparatus according to the embodiment of the present invention, the worker can support the weight of the outdoor unit with middle phalanxes or proximal phalanxes of the fingers, which are portions closer to the bases than the tips. Therefore, when moving the outdoor unit of the air-conditioning apparatus, the worker does not feel that the outdoor unit is heavy, as compared with the case where an existing outdoor unit is moved. Therefore, according to the embodiment of the present invention, it is possible to improve the workability with which the outdoor unit of the air-conditioning apparatus is moved, as compared with the case where the existing outdoor unit is moved.

DESCRIPTION OF EMBODIMENTS

Embodiment 1

Figure 1:
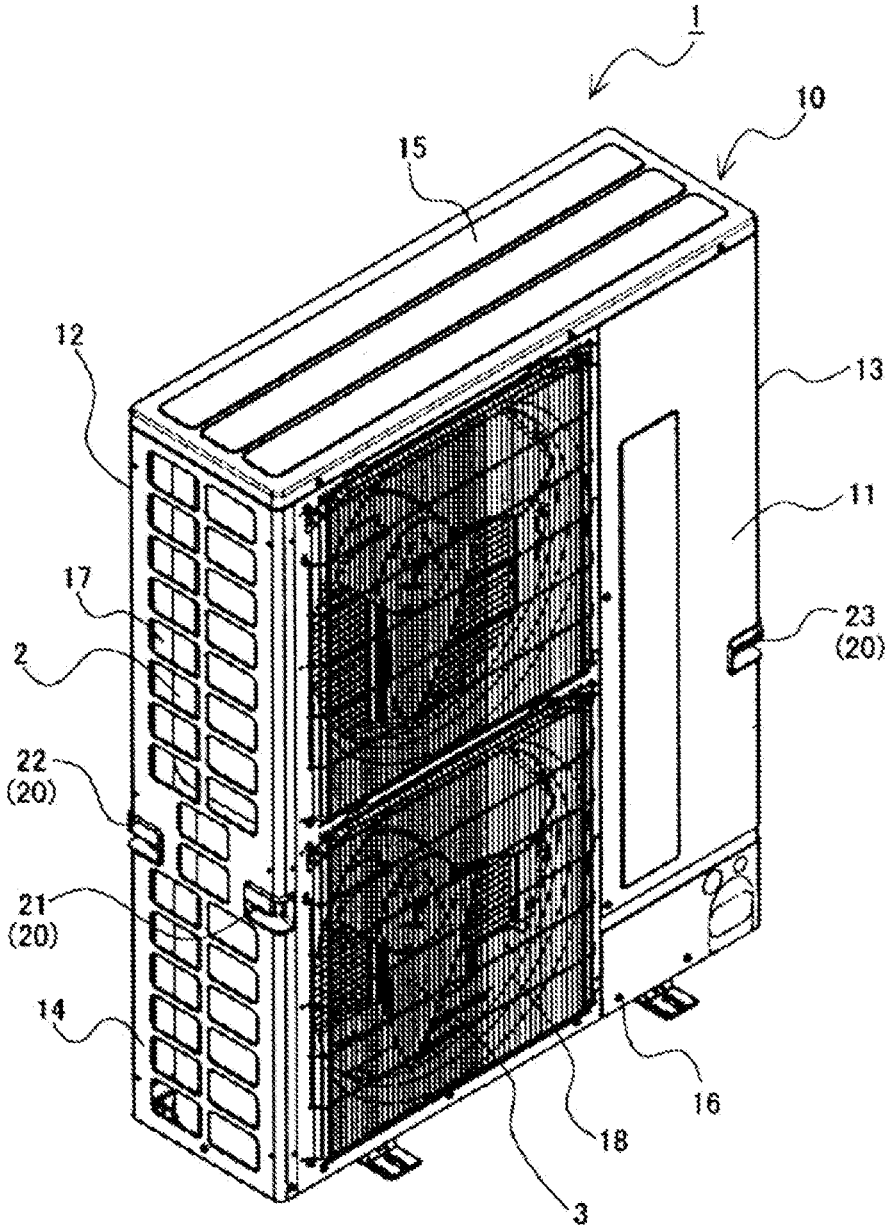
FIG. 1 is a perspective view illustrating an outdoor unit of an air-conditioning apparatus according to embodiment 1 of the present invention as seen from a front side of the outdoor unit.

FIG. 1 is a perspective view illustrating an outdoor unit of an air-conditioning apparatus according to embodiment 1 of the present invention as seen from a front side of the outdoor unit.

An outdoor unit 1 of the air-conditioning apparatus according to embodiment 1 includes a casing 10 having the shape of, for example, a substantially rectangular parallelepiped. Specifically, the casing 10 includes a front surface portion 11, a back surface portion 12, a right side surface portion 13, a left side surface portion 14, a top surface portion 15 and a bottom surface portion 16. The front surface portion 11 forms a front surface of the casing 10. The back surface portion 12 forms a back surface of the casing 10. The right side surface portion 13 forms a side surface on a right side of the casing 10 as the casing 10 is seen head-on from a front side thereof. The left side surface portion 14 forms a side surface on a left side of the casing 10 as the casing 10 is seen head-on. The top surface portion 15 forms a top surface of the casing 10. The bottom surface portion 16 forms a bottom surface of the casing 10.

In the casing 10, air inlets 17 and air outlets 18 are formed. The air inlets 17 are formed in the left side surface portion 14 and the back surface portion 12. The air outlets 18 are formed in the front surface portion 11. A heat exchanger 2 and propeller fans 3 are housed as components in the casing 10. To be more specific, the heat exchanger 2 is housed in the casing 10 in such a way as to face the air inlets 17, The propeller fans 3 are housed in the casing 10 in such a way as to face the air outlets 18. Also, in the casing 10, electrical components, a compressor, pipes, etc., are also housed as components.

It should be noted that the outdoor unit 1 as illustrated in FIG. 1 is a large-capacity outdoor unit including two propeller fans 3, but this is merely an example of the outdoor unit 1 according to embodiment 1. For example, the outdoor unit 1 according to embodiment 1 may be a small-capacity outdoor unit including a single propeller fan 3. Also, although the outdoor unit 1 is a horizontal-blow outdoor unit as illustrated in FIG. 1, a vertical-blow outdoor unit may be adopted as the outdoor unit 1.

The outdoor unit 1 is provided with grasp portions 20 provided at at least two respective positions at corner portions of the casing 10 as seen in plan view. That is, the outdoor unit 1 includes at least two grasp portions 20. For example, at the time of carrying the outdoor unit 1 or at the time of installing the outdoor unit 1, a worker sometimes vertically moves the outdoor unit 1, and also sometimes horizontally moves the outdoor unit 1. At this time, the worker grasps the grasp portions 20 of the outdoor unit 1, and moves the outdoor unit 1. It should be referred noted that the grasp portions 20 may be each referred to as a handle.

Specifically, the outdoor unit 1 according to embodiment 1 is provided with four grasp portions 20. Of the four grasp portions 20, a grasp portion 21 is a grasp portion 20 provided at a corner portion between the front surface portion 11 and the left side surface portion 14; a grasp portion 22 is a grasp portion 20 provided at a corner portion between the back surface portion 12 and the left side surface portion 14; a grasp portion 23 is a grasp portion 20 at a corner portion between the front surface portion 11 and the right side surface portion 13; and the other grasp portion, which is not illustrated in FIG. 1, is a grasp portion 20 provided at a corner portion between the back surface portion 12 and the right side surface portion 13, and will be referred to as a grasp portion 24.

It should be noted that in the case of lifting up the outdoor unit 1, one worker needs to grasp at least two grasp portions 20. Therefore, it suffices that the number of grasp portions 20 to be provided is set to two or more as appropriate in accordance with, for example, the number of persons who are required to move the outdoor unit 1.

As described above, in the case of, for example, carrying the outdoor unit 1 or installing the outdoor unit 1, the worker moves the outdoor unit 1 while grasping the grasp portions 20 of the outdoor unit 1. In urban agglomerations or the like, there is a case where the outdoor unit 1 is required to be installed on the rooftop of a building, and also where the worker must go upstairs to carry the outdoor unit 1. In such a case, the grasp portions 20 to be grasped by the worker are required to have a structure which can reduce a physical load which would act on the worker at the time of carrying the outdoor unit 1, and to improve the workability.

In an existing outdoor unit, grasp portions are formed to allow the worker to insert his or her fingers other than his or her thumbs into the grasp portions, and support the weight of the outdoor unit with the fingers at the time of moving the outdoor unit. The worker may be an old man, a young man, an old woman or a young woman, and the size and shape of the hand thus vary from one worker to another. Furthermore, from the standpoint of safety at the time of moving the outdoor unit, the worker wears protectors such as gloves on his or her hands, and then grasps the grasp portions. Therefore, in the existing outdoor unit, in order to reduce the physical load on the worker at the grasp portions of the outdoor unit, the grasp portions need to be formed to have sufficient widths to allow the worker to insert his or her fingers other than his or her thumbs into the grasp portions until the fingers reach innermost portions thereof, and support the outdoor unit with his or her middle phalanges or proximal phalanges of those fingers, even if the worker has big hands and wears protectors.

However, components such as electrical components, a compressor, pipes and a heat exchanger are housed in the casing of the outdoor unit. Furthermore, in recent years, air-conditioning apparatuses have been required to have a higher performance and a smaller size, and the occupancy rate of the components in the casing has thus been higher. Therefore, in the casings of outdoor units of recent times, areas for grasp portions have been smaller. Thus, it is harder to provide large grasp portions at the casing of the outdoor unit.

Therefore, in the existing outdoor unit, when the worker inserts his or her fingers other than his or her thumbs into the grasp portions in order to move the outdoor unit, because the grasp portions have small widths, only tips of the fingers can be inserted into the grasp portions even if the fingers are held tightly together. Inevitably, the outdoor unit must be supported only by the tips of the fingers. Therefore, in the existing outdoor unit, the worker feels that the outdoor unit is heavy, at the time of moving the outdoor unit, and the workability is worse.

In view of the above, the grasp portions 20 of the outdoor unit 1 according to embodiment 1 are shaped as described below. It should be note that of the grasp portions 20, the grasp portions 22 and 24 have the same shape; and the grasp portions 21 and 23 have the same shape, and their shapes are lateral mirror images of the shapes of the grasp portions 22 and 24, respectively. Therefore, in the following, the shapes of the grasp portions 20 are described by referring to the shape of the grasp portion 22.

Figure 2:
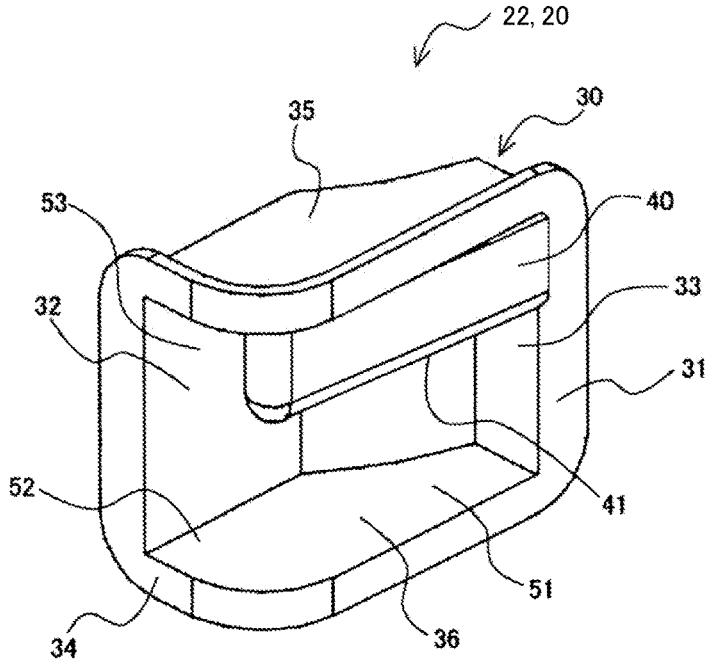
FIG. 2 is a perspective view illustrating a grasp portion of the outdoor unit of the air-conditioning apparatus according to embodiment 1 of the present invention.
Figure 3:
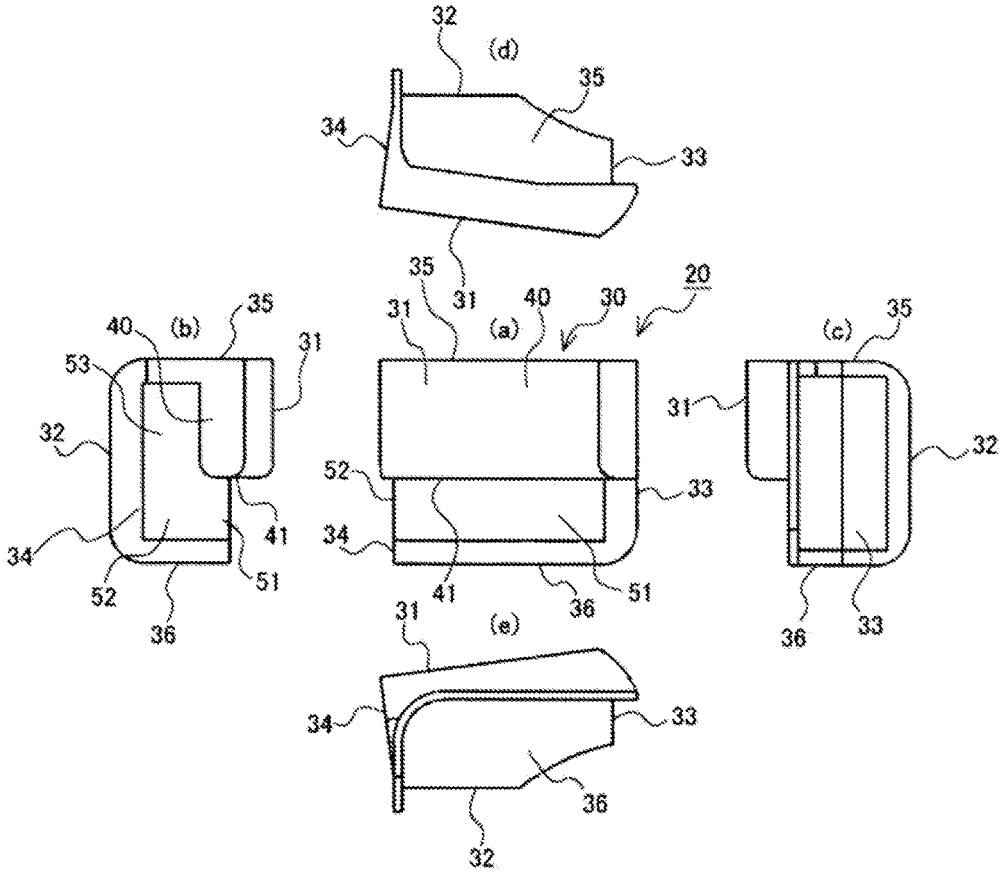
FIG. 3 is a diagram illustrating the grasp portion of the outdoor unit of the air-conditioning apparatus according to embodiment 1 of the present invention.

FIG. 2 is a perspective view illustrating a grasp portion formed at the outdoor unit of the air-conditioning apparatus according to embodiment 1 of the present invention. FIG. 3 is a diagram illustrating the grasp portion of the outdoor unit of the air-conditioning apparatus according to embodiment 1 of the present invention. FIG. 3(*a*), is a front view of the grasp portion 22. FIG. 3(*b*), is a left-side view of the grasp portion 22. FIG. 3(*c*) is a right-side view of the grasp portion 22. FIG. 3(*d*), is a plan view of the grasp portion 22. FIG. 3(*e*), is a bottom view of the grasp portion 22. As described above, the grasp portion 20 is provided at a corner portion of the casing 10 as seen in plan view. Therefore, two surface portions of the grasp portion 20 are exposed to the outside of the casing 10. Of the surface portions exposed to the outside of the casing 10, a surface portion having a greater length in a horizontal direction is a front surface portion 31. For example, in the grasp portion 22, a surface portion exposed from the left side surface portion 14 of the casing 10 to the outside thereof is the front surface portion 31.

The grasp portion 22 includes an outer peripheral portion 30 and a finger hook portion 40. The outer peripheral portion 30 forms an outer periphery of the grasp portion 22. In embodiment 1, the outer peripheral portion 30 is formed in the shape of a substantially rectangular parallelepiped, and includes the front surface portion 31, a back surface portion 32, a right side surface portion 33, a left side surface portion 34, a top surface portion 35 and a bottom surface portion 36. Of the two surface portions exposed to the outside of the casing 10, the front surface portion 31 is the surface portion having a greater length in the horizontal direction. The back surface portion 32 is a surface portion located opposite to the front surface portion 31. In the grasp portion 22, the back surface portion 32 faces the front surface portion 31 in a left-and-right direction of the casing 10, which is a direction from one of the right and left sides of the casing 10 toward the other.

The left side surface portion 34 forms one of end portions of the grasp portion 22 which are located at ends of the grasp portion 22 in a lateral direction thereof which is a direction from one of right and left sides of the grasp portion 22 toward the other. Specifically, as the grasp portion 22 is seen from a front surface portion 31 side, the left side surface portion 34 forms an end portion of the grasp portion 22 which is located on a left side thereof. Also, the left side surface portion 34 is one of the two surface portions exposed to the outside of the casing 10, which has a smaller length in the horizontal direction. Furthermore, the left side surface portion 34 is exposed from the back surface portion 12 of the casing 10 to the outside thereof. The right side surface portion 33 forms the other one of the end portions of the grasp portion 22 which are located at ends of the grasp portion 22 in the lateral direction thereof. To be more specific, as the grasp portion 22 is seen from the front surface portion 31 side, the right side surface portion 33 forms an end portion of the grasp portion 22, which is located on the right side thereof. In other words, the right side surface portion 33 is located opposite to the left side surface portion 34 in a front-and-back direction of the casing 10, which is a direction from one of front and back sides of the casing 10 toward the other. That is, the lateral direction of the grasp portion 22 coincides with the front-and-back direction of the casing 10. The top surface portion 35 corresponds to the top of the grasp portion 22. The bottom surface portion 36 corresponds to the bottom of the grasp portion 22.

The finger hook portion 40 protrudes downwards from the top surface portion 35, which also corresponds to the top of the outer peripheral portion 30, and extends in the lateral direction. That is, the finger hook portion 40 of the grasp portion 22 extends in the front-and-back direction of the casing 10. The finger hook portion 40 is part of the grasp portion that catches the worker's fingers when the worker grasps the grasp portion 20 to move the outdoor unit 1. In this case, middle phalanges or proximal phalanges of at least three of the fingers on each hand of the worker, which are other than, his or her thumb, contact a lower end portion 41 of the finger hook portion 40.

In the outer peripheral portion 30, a first opening 51, a second opening 52 and a third opening 53 are formed. The first opening 51 is formed such that the lower end portion 41 of the finger hook portion 40 is exposed at the front surface portion 31. In other words, the first opening 51 is formed such that the lower end portion 41 of the finger hook portion 40 is exposed as seen in the horizontal direction and a direction perpendicular to the lateral direction in which the finger hook portion 40 extends. It should be noted that part of the front surface portion 31 that is located above the first opening 51 may be used as the finger hook portion 40. In this case, an upper edge portion of the first opening 51 corresponds to the lower end portion 41 of the finger hook portion 40. Also, in this case, it can be said that the first opening 51 is formed such that the lower end portion 41 of the finger hook portion 40 is exposed as seen from the direction perpendicular to the lateral direction which is horizontal and in which the finger hook portion 40 extends.

The second opening 52 and the third opening 53 are formed at one of the end portions of the outer peripheral portion 30 which are located at ends thereof in the lateral direction. Specifically, the second opening 52 and the third opening 53 are formed at one of the surface portions forming the respective end portions of the outer peripheral portion 30 in the lateral direction, and the above one of the surface portions is a surface portion exposed to the outside the of casing 10. Therefore, in the grasp portion 22, the second opening 52 and the third opening 53 are formed at the left side surface portion 34. The second opening 52 is located below the finger hook portion 40, and is continuous with the first opening 51. The third opening 53 is located behind the finger hook portion 40, and is continuous with the second opening 52.

Next, it will be described what operation is performed in order to move the outdoor unit 1 according to embodiment 1.

In the case of moving the outdoor unit 1, the worker faces his or her palms or thumbs toward the front surface portions 31 of the grasp portions 20, and inserts his or her fingers other than his or her thumbs between the finger hook portions 40 and the back surface portions 32. It should be noted that in the case of inserting the four fingers other than the thumb on one hand between the finger hook portion 40 and the back surface portion 32, these fingers may be inserted from the first opening 51, or from the second opening 52 and the third opening 53. That is, in the grasp portion 20 according to embodiment 1, since the second opening 52 and the third opening 53 are formed at an end portion located at the end in the lateral direction, the fingers on one hand, that are other than the thumb, can also be inserted between the finger hook portion 40 and the back surface portion 32 from a side of the grasp portion 20.

Subsequently, the worker faces his or her palms toward the front surface portions 31 of the grasp portions 20, and grasps the finger hook portion 40, with his or her fingers, which are other than his or her thumbs, inserted between the finger hook portions 40 and the back surface portions 32. It should be noted that there is a case where in the casing 10, regions for providing the grasp portions 20 are not large, and the grasp portions 20 are each made short in the width direction thereof. In other words, there is a case where because the regions for the grasp portions 20 in the casing 10 are small, the grasp portions 20 cannot be made long in the lateral direction, in which the finger hook portion 40 extends.

Even in such a case, in the grasp portion 20 according to embodiment 1, at least part of a forefinger or a little finger can be projected from the grasp portion 20 to the outside thereof through the second opening 52 and the third opening 53 formed in the end portion of the grasp portion 20 which is located at an end in the lateral direction. Therefore, in the outdoor unit 1 according to embodiment 1, the worker can insert his or her fingers to be inserted into the grasp portions 20 into the grasp portions 20 until portions of the fingers which are closer to bases of the fingers than tips thereof are located in the grasp portion 20. Therefore, at the time of moving the outdoor unit 1 according to embodiment 1, the worker can bring middle phalanxes or proximal phalanxes, which are the above portions closer to the bases than the tips, into contact with the lower end portions 41 of the finger hook portions 40. In other words, the middle phalanges or the proximal phalanges of three or more of the fingers on one hand can be brought into contact with the lower end portion 41 of the finger hook portion 40. That is, in the case of moving the outdoor unit 1 according to embodiment 1, the worker can support the weight of the outdoor unit 1 with the middle phalanges or the proximal phalanges, which are portions closer to the bases than the tips.

Therefore, when moving the outdoor unit 1 according to embodiment 1, the worker does not feel that the outdoor unit is heavy, as compared with the case where the worker moves the existing outdoor unit. That is, from an ergonomic point of view, the outdoor unit 1 according to embodiment 1 can reduce a physical load on the worker. Therefore, the outdoor unit 1 according to embodiment 1 can be moved with a higher efficiency than the existing outdoor unit, thus improving the workability. It should be noted that as described above, in the outdoor unit 1 according to embodiment 1, the fingers on one hand that are other than the thumb can be inserted between the finger hook portion 40 and the back surface portion 32 from a side of the grasp portion 20. On this point also, the workability at the time of moving the outdoor unit 1 according to embodiment 1 can be improved, as compared with the existing the outdoor unit.

Furthermore, in the outdoor unit 1 according to embodiment 1, it is possible to prevent the weight of the outdoor unit 1 from acting on the fingertips at the time of moving the outdoor unit 1, and thus also improve safety.

Furthermore, as described above, the grasp portion 20 according to embodiment 1 is provided with the second opening 52 and the third opening 53 both formed at the above-mentioned end portion which is located at the end in the lateral direction. Thus, in the case of molding the grasp portion 20 from resin, a mold part for providing space between the finger hook portion 40 and the back surface portion 32, that is space for insertion of fingers, can be pulled out through the second opening 52 and the third opening 53. Therefore, the grasp portion 20 may be molded from resin by using a pair of molds that are moved relative to each other in the lateral direction, which is the extending direction of the finger hook portion 40. Thus, the grasp portion 20 of the outdoor unit 1 according to embodiment 1 can be manufactured at a low cost, and the cost of the outdoor unit 1 can be reduced.

As described above, the outdoor unit 1 of an air-conditioning apparatus according to embodiment 1 includes the casing 10 and at least two grasp portions 20 which are provided at respective positions that correspond to corner portions of the casing 10 as seen in plan view. The grasp portions 20 each include the outer peripheral portion 30 which forms the outer periphery of each grasp portion 20, and the finger hook portion 40 which protrudes downward from the upper portion of the outer peripheral portion 30 and also extends in the lateral direction. In each outer peripheral portion 30, the first opening 51 is provided such that the lower end portion 41 of the finger hook portion 40 is exposed as seen in the horizontal direction and the direction perpendicular to the lateral direction. The second opening 52 formed below the finger hook portion 40 and continuous with the first opening 51 and the third opening 53 formed behind the finger hook portion 40 and continuous with the second opening 52 are provided at one of end portions of each outer peripheral portion 30 which are located at the ends in the lateral direction.

As described above, in the outdoor unit 1 according to embodiment 1 having the above configuration, the worker may support the weight of the outdoor unit 1 with the middle phalanges or the proximal phalanges of his or her fingers, which are parts closer to the bases than the tips. Therefore, when moving the outdoor unit 1 according to embodiment 1, the worker feels that the outer door unit 1 is lighter than when he or she moves the existing outdoor unit. Thus, the workability with which the worker moves the outdoor unit 1 according to embodiment 1 are improved, as compared with the case of moving the existing outdoor unit.

Embodiment 2

With respect to embodiment 2, it will be described what advantage is obtained by providing the finger hook portions 40 of adjacent grasp portions 20 such that the finger hook portions 40 face in the same direction. In embodiment 2, matters not specifically described are the same as those of embodiment 1, and functions and components which are the same as those in embodiment 1 will be denoted by same reference signs.

Figure 4:
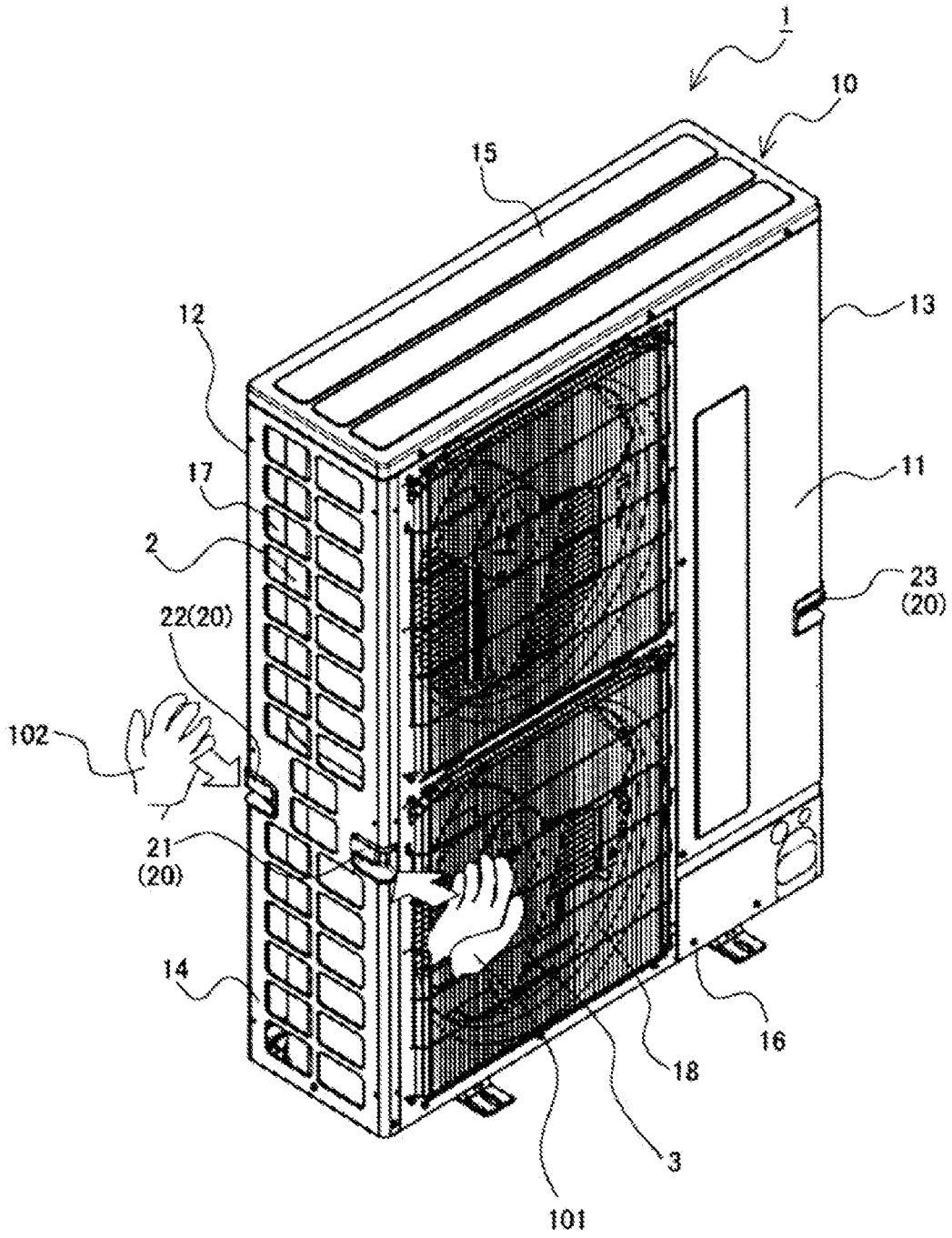
FIG. 4 is a perspective view illustrating an outdoor unit of an air-conditioning apparatus according to embodiment 2 of the present invention as seen from a front side of the outdoor unit.

FIG. 4 is a perspective view illustrating an outdoor unit of an air-conditioning apparatus according to embodiment 2 of the present invention as seen from a front side of the outdoor unit.

In each of the grasp portions 21 and 22, which are adjacent to each other, in the outdoor unit 1 according to embodiment 2, the lateral direction in which the finger hook portion 40 extends coincides with the front-and-back direction of the casing 10, which is a direction from one of the front and back sides of the casing 10 toward the other. Therefore, the front surface portions 31 of the grasp portions 21 and 22 are exposed from the left side surface portions 14 of the casing 10 to the outside thereof. Also, the right side surface portion 33 of the grasp portion 21 is exposed from the front surface portion 11 of the casing 10 to the outside thereof. The second opening 52 and the third opening 53 of the grasp portion 21 are formed at the right side surface portion 33. Furthermore, the left side surface portion 34 of the grasp portion 22 is exposed from the back surface portion 12 of the casing 10 to the outside thereof. The second opening 52 and the third opening 53 of the grasp portion 22 are formed at the left side surface portion 34.

According to embodiment 2, in the case where one worker moves the outdoor unit 1 while grasping the grasp portions 21 and 22, he or she can insert his or her fingers into the grasp portions 21 and 22 in directions indicated by outlined arrows in FIG. 4. To be more specific, the worker can insert fingers on his or her right hand 101 into the grasp portion 21 from a side close to the front surface portion 11 of the casing 10. Also, the worker can insert fingers on his or her left hand 102 into the grasp portion 22 from a side close to the back surface portion 12 of the casing 10. Therefore, in embodiment 2, because the grasp portions 21 and 22 are provided at the casing 10 as described above, the worker can easily insert his or her fingers into the grasp portions 21 and 22, and the workability with which the worker moves the outdoor unit 1 can be further improved.

It should be noted that in the grasp portions 23 and 24 also, which are adjacent to each other, the lateral direction in which the finger hook portion 40 extends may be set to coincide with the front-and-back direction of the casing 10. In this case also, it is possible to improve the workability with which the worker moves the outdoor unit 1 while grasping the grasp portions 23 and 24.

Embodiment 3

In embodiment 3, the finger hook portions 40 of adjacent grasp portions 20 are provided to face in the same direction. In embodiment 3, matters not specifically described are the same as those of embodiment 1 or 2, and functions and components which are the same as those in embodiment 1 or 2 will be denoted by same reference signs.

Figure 5:
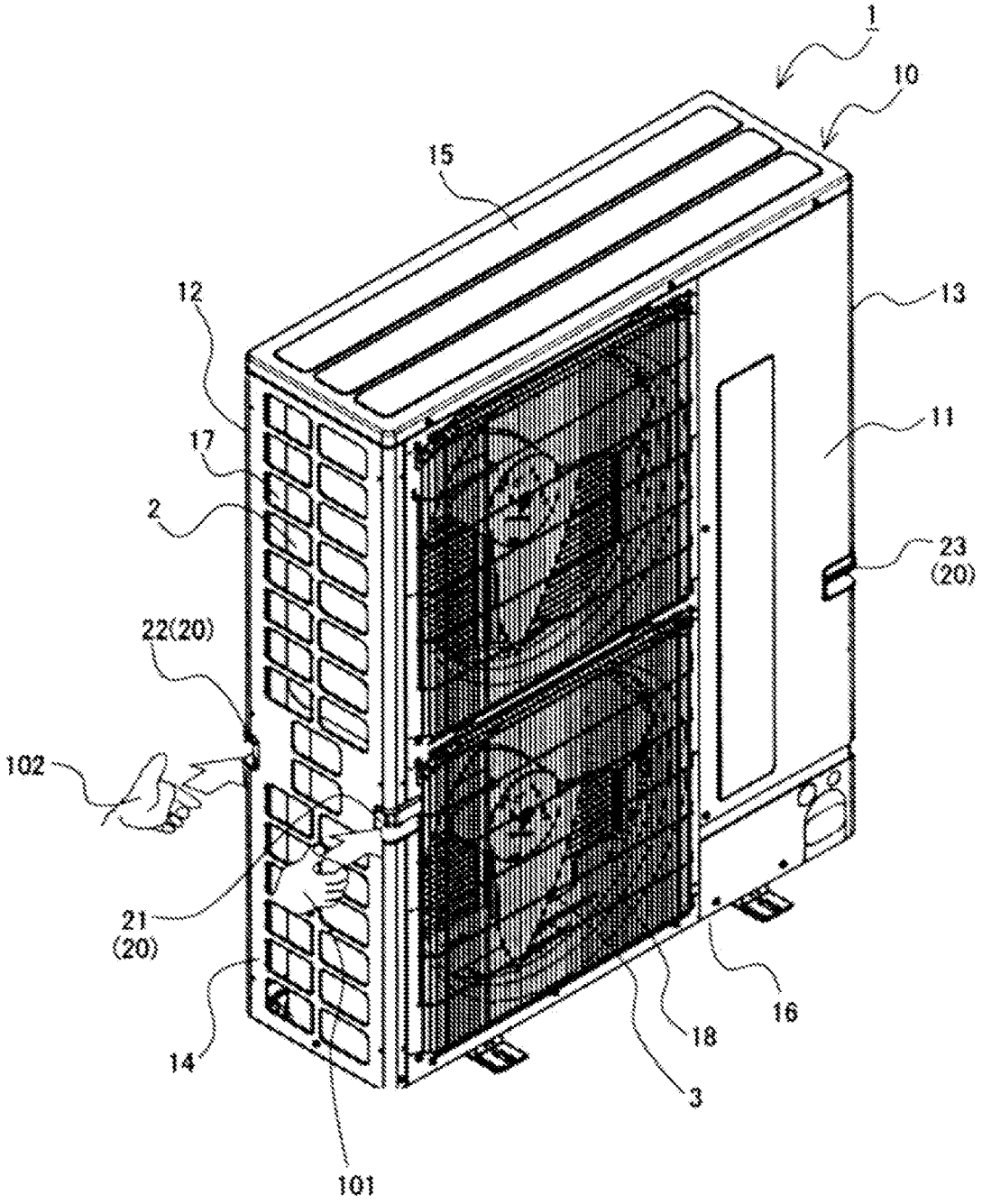
FIG. 5 is a perspective view illustrating an outdoor unit of an air-conditioning apparatus according to embodiment 3 of the present invention as seen from a front side of the outdoor unit.

FIG. 5 is a perspective view illustrating an outdoor unit of an air-conditioning apparatus according to embodiment 3 of the present invention as seen from a front side of the outdoor unit.

In the adjacent grasp portions 21 and 22 in the outdoor unit 1 according to embodiment 3, the lateral direction along which the finger hook portion 40 extends coincides with the left-and-right direction of the casing 10. Thus, the front surface portion 31 of the grasp portion 21 is exposed from the front surface portion 11 of the casing 10 to the outside thereof. The front surface portion 31 of the grasp portion 22 is exposed from the back surface portion 12 of the casing 10 to the outside thereof. The left side surface portion 34 of the grasp portion 21 is exposed from the left side surface portion 14 of the casing 10 to the outside thereof. The second opening 52 and the third opening 53 of the grasp portion 21 are formed at the left side surface portion 34. The right side surface portion 33 of the grasp portion 22 is exposed from the left side surface portion 14 of the casing 10 to the outside thereof. Furthermore, in the grasp portion 22, the second opening 52 and the third opening 53 are formed at the right side surface portion 33.

In the outdoor unit 1 according to embodiment 3, when moving the outdoor unit 1 while grasping the grasp portions 21 and 22, the worker faces the palm of the right hand 101 toward the front surface portion 11 of the casing 10, and also faces the palm of the left hand 102 toward the back surface portion 12 of the casing 10. The worker can thereby hold the outdoor unit 1 using his or her whole body. When the worker takes such a posture, he or she easily tighten his or her whole body. Thus, because the grasp portions 21 and 22 are provided at the casing 10 as described above, it is possible to further reduce the physical load on the worker. Therefore, in embodiment 3, because of the above configuration of grasp portions 21 and 22 at the casing 10, the workability and safety with which the worker moves the outdoor unit 1 are further improved.

It should be noted that in the adjacent gasp portions 23 and 24, the lateral direction along which the finger hook portion 40 extends may be set to coincide with the left-and-right direction of the casing 10. In this case also, it is possible to further improve the workability and safety with which the worker moves the outdoor unit 1 while grasping the grasp portions 23 and 2.

Embodiment 4

The workability and safety with which the worker who moves the outdoor unit 1 can be further improved by forming the grasp portion 20 as described below with respect to embodiment 4. In embodiment 4, matters not specifically described are the same as those of any of embodiments 1 to 3, and functions and components which are the same as those in any of embodiments 1 to 3 will be denoted by same reference signs.

Figure 6:
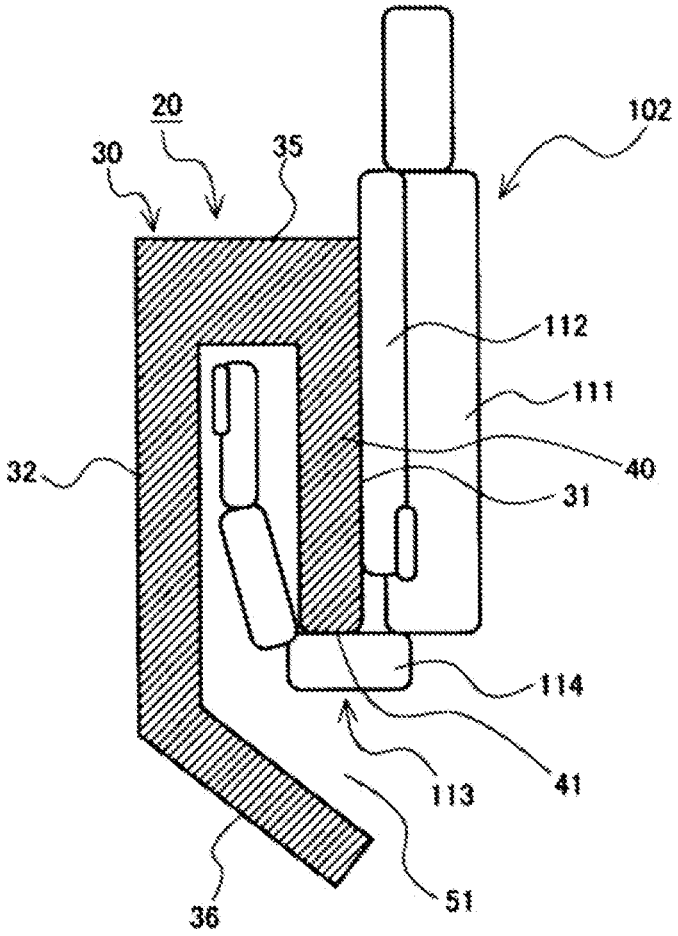
FIG. 6 is a vertical sectional view illustrating a grasp portion of an outdoor unit of an air-conditioning apparatus according to embodiment 4 of the present invention.

FIG. 6 is a vertical cross-sectional view illustrating a grasp portion of an outdoor unit of an air-conditioning apparatus according to embodiment 4 of the present invention. It should be noted that in FIG. 6, the left hand 102 is illustrated as an example of a hand grasping the grasp portion 20.

As described above, in the case of moving the outdoor unit 1, the worker faces his or her palm 111 and thumb 112 on one hand toward the front surface portion 31 of the grasp portion 20, and inserts his or her fingers on one hand that are other than his or her thumb, that is, four fingers 113, between the finger hook portion 40 and the back surface portion 32. In the grasp portion 20 according to embodiment 4, a length of the finger hook portion 40 in a direction from one of the top and bottom of the finger hook portion 40 toward the other is set such that tips of the fingers 113 do not contact the top surface portion 35 when proximal phalanges 114 of three or more of the fingers 113 are brought into contact with the lower end portion 41 of the finger hook portion 40, with the fingers inserted between the finger hook portion 40 and the back surface portion 32.

By virtue of the above configuration of the grasp portion 20, the weight of the outdoor unit 1 can be supported by the proximal phalanges 114 of the fingers 113. To be more specific, when supporting the weight of the outdoor unit 1 with the proximal phalanges 114 of the fingers 113, the worker feels that the outdoor unit 1 is lighter than when he or she supports the weight of the outdoor unit 1 with middle phalanges of the fingers 113. Thus, the physical load on the worker is reduced. Therefore, in embodiment 4, because of the above configuration of the grasp portion 20, it is possible to further improve the workability and safety with which the worker moves the outdoor unit 1.

REFERENCE SIGNS LIST

1 outdoor unit 2 heat exchanger 3 propeller fan 10 casing 11 front surface portion 12 back surface portion 13 right side surface portion 14 left side surface portion 15 top surface portion 16 bottom surface portion 17 air inlet 18 air outlet 20 grasp portion

21 grasp portion 22 grasp portion 23 grasp portion 24 grasp portion 30 outer peripheral portion 31 front surface portion 32 back surface portion 33 right side surface portion 34 left side surface portion

35 top surface portion 36 bottom surface portion 40 finger hook portion

41 lower end portion 51 first opening 52 second opening 53 third opening 101 right hand 102 left hand 111 palm 112 thumb

113 finger 114 proximal phalanx

The invention claimed is:

1. An outdoor unit of an air-conditioning apparatus, comprising:

a casing; and grasp portions provided at at least two respective positions at corner portions of the casing as seen in plan view, wherein the grasp portions each include an outer peripheral portion forming an outer periphery of each grasp portion, and a finger hook portion protruding downwards from an upper part of the outer peripheral portion and extending in a lateral direction of the finger hook portion, and wherein the outer peripheral portion includes a first opening provided such that a lower end portion of the finger hook portion is exposed as seen in a horizontal direction and a direction perpendicular to the lateral direction, a second opening provided below the finger hook portion and continuous with the first opening, and a third opening provided behind the finger hook portion and above and continuous with the second opening, the second opening and the third opening being provided at one of end portions of the outer peripheral portion which are located at ends thereof in the lateral direction, the second opening and the third opening both being exposed at the one of end portions as seen in side view thereof.

2. The outdoor unit of claim 1, wherein two of the grasp portions that are adjacent to each other are located such that the lateral direction coincides with a front-and-back direction of the casing, which is a direction from one of front and back sides of the casing toward the other.

3. The outdoor unit of claim 1, wherein two of the grasp portions that are adjacent to each other are located such that the lateral direction coincides with a left-and-right direction of the casing, which is a direction from one of left and right sides of the casing toward the other.

4. The outdoor unit of claim 1, wherein the grasp portions are each formed to allow proximal phalanges of at least three of fingers on an associated one of hands of a worker to contact the lower end portion of the finger hook portion of the each grasp portion.

* * * * *